US005667075A

United States Patent [19]

Konetzka

[11] Patent Number: 5,667,075

[45] Date of Patent: Sep. 16, 1997

[54] CLASSIFYING WHEEL FOR CENTRIFUGAL-WHEEL CLASSIFIERS

[75] Inventor: Georg Konetzka, Augsburg, Germany

[73] Assignee: Hosokawa Alpine Aktiengesellschaft, Augsburg, Germany

[21] Appl. No.: 516,565

[22] Filed: Aug. 18, 1995

[30] Foreign Application Priority Data

Apr. 7, 1995 [DE] Germany ..... 295 06 015.8

[51] Int. Cl.[6] ..... B07B 1/22

[52] U.S. Cl. ..... 209/303; 209/406

[58] Field of Search ..... 209/288, 393, 209/395, 397, 405, 406, 139.1, 139.2

[56] References Cited

U.S. PATENT DOCUMENTS

| | | | |
|---|---|---|---|
| 1,203,881 | 11/1916 | King | 209/406 X |
| 1,633,126 | 6/1927 | Paynter | 209/406 |
| 1,812,468 | 6/1931 | Brooke | 209/397 |
| 2,006,867 | 7/1935 | Mjolsness | 209/397 X |
| 2,255,807 | 9/1941 | Plumlee | 209/211 |
| 2,996,187 | 8/1961 | Payne | 209/211 |
| 3,089,595 | 5/1963 | Kaiser | 209/144 |
| 3,152,078 | 10/1964 | Lavanchy | 210/297 |
| 3,276,584 | 10/1966 | Mathewson | 209/397 X |
| 4,257,880 | 3/1981 | Jones | 209/139.1 |
| 4,264,438 | 4/1981 | Frejborg | 209/303 X |
| 4,528,091 | 7/1985 | Nied et al. | 209/139 |
| 4,710,284 | 12/1987 | Amit | 209/17 |
| 4,729,837 | 3/1988 | Henricson | 210/784 |
| 4,786,406 | 11/1988 | Nied et al. | 209/139.1 |
| 4,832,832 | 5/1989 | Fujiwara et al. | 209/397 X |
| 4,863,605 | 9/1989 | Rienecker | 210/512.3 |
| 5,064,537 | 11/1991 | Chupka et al. | 209/397 X |
| 5,284,150 | 2/1994 | Stepenhoff | 209/211 |
| 5,377,843 | 1/1995 | Schumacher . | |

FOREIGN PATENT DOCUMENTS

| | | | |
|---|---|---|---|
| 0115057 | 12/1983 | European Pat. Off. . | |
| 0355235 | 6/1989 | European Pat. Off. . | |
| 4135879 | 10/1991 | Germany . | |
| 41 40 656 C1 | 9/1992 | Germany . | |
| 4214771 | 11/1993 | Germany . | |
| 4-1994 | 4/1994 | Germany | 209/406 |
| 1-297182 | 11/1989 | Japan . | |
| 4-62785 B2 | 6/1991 | Japan . | |
| 1005929 | 3/1983 | U.S.S.R. . | |
| 1656610 | 5/1991 | U.S.S.R. . | |
| 1036543 | 2/1965 | United Kingdom . | |

OTHER PUBLICATIONS

F. Kaiser, *Alpine Sonderdruck 29*, "Der Zickzack—Sichter, ein Wind sichter nach neuem Prinzip" (4962) (no translation provided).

*Primary Examiner*—D. Glenn Dayoan
*Attorney, Agent, or Firm*—Pennie & Edmonds LLP

[57] ABSTRACT

The invention concerns the design of classifying wheel made of a waterproof sintered material with vanes arranged in a ring that run parallel to the rotational axis and that are positioned between the hub-bearing circular disc and an annular cover disc, whereby the flow of the classifying air through the vanes is contrary to the centrifugal direction of the classifying wheel. Described is a classifying wheel design which permits manufacture of such a classifying wheel in an economical manner with a high degree of manufacturing accuracy even if the classifying wheel has an outside diameter in excess of 250 mm and which ensures the required degree of fracture resistance for any standard sintered material. This is achieved in that the classifying wheel is made up of simple ring elements joined together by a self-sintering filler, e.g. an adhesive, introduced into the gaps between the ring elements.

18 Claims, 1 Drawing Sheet

CLASSIFYING WHEEL FOR CENTRIFUGAL-WHEEL CLASSIFIERS

BACKGROUND OF THE INVENTION

The invention relates to an air classifier with a rotating classifying wheel through which the classifying air flows against its centrifugal direction, from the outside to the inside, with vanes arranged in a ring parallel to the rotational axis and positioned between a circular disc that bears the classifying wheel hub and an annular-shaped cover disc. The invention concerns a classifying wheel for this type of air classifier that is completely made of a wearproof sintered material.

BACKGROUND OF THE INVENTION

A classifying wheel of this type is already known, for example, from U.S. Pat. No. 5,377,843. In the case of this classifying wheel, the circular disc with hub, the cover disc and the vanes that run parallel to the rotational axis arranged between these two discs are all manufactured from one piece of material. The boring in the hub has a semi-circular groove to accommodate a matching feather key for the torque transmission and is finished to size to permit direct installation of the classifying wheel onto its drive shaft. The flow channels between the vanes are formed by the planes of the vanes that run parallel to each other in the direction of the rotational axis; these channels are joined with each other in the transitional area to the circular disc or cover disc by means of an arched plane. This type of design permits a comparatively high degree of manufacturing accuracy that eliminates the need to balance the finished classifying wheel.

It was found in this context, however, that in the case of classifying wheels with outside diameters in excess of 250 mm as well as in the case of certain sintering materials, this manufacturing accuracy cannot be achieved without a high and thus uneconomical cost outlay. In addition, these classifying wheels displayed an insufficient resistance to fracture if certain sintering materials, e.g. aluminum-oxide ceramic, were employed.

SUMMARY OF THE INVENTION

The objective of this invention was to design a classifying wheel to have the characteristics detailed in the background but one that is also economical to manufacture to a high degree of manufacturing accuracy even when the outside diameter of the classifying wheel exceeds 250 mm and which furthermore has the required resistance to fracture when all standard sintering materials are utilized in the manufacture.

The solution to this task is a classifying wheel that consists of simple cylindrical ring elements joined together by a selfsetting filler introduced into the gaps between the ring elements that were finished to size and balanced before assembly. As long as the gap width is no more than 0.1 mm, the filler can either be an adhesive or a soldering metal. The main component of the classifying wheel is a section of pipe whose external dimensions dictate the main dimensions—diameter and height—of the classifying wheel itself. Machined into this pipe section are flow channels that are radially aligned and distributed uniformly around the periphery, whose limiting planes run parallel to each other in the direction of the rotational axis and that are joined together at either end by means of an arch section, so that classifying wheel vanes are formed with a cross-section that tapers radially to the inside. The axial distance between an arch section and a neighboring front surface of the pipe section is thereby at least the same gauge as that of the wheel-hub-bearing circular disc or the annular-shaped cover disc, because both are inserted into the pipe section in such a way that their external front surfaces form one plane with the corresponding front surface of the pipe section. The axial orientation of the circular disc and cover disc can be defined by means of an annular-shaped stop face worked into the pipe section or by conically modelling the surfaces contacted by the soldered or fluid joints. The connection between the hub and the circular disc is designed accordingly.

It is also possible, however, to construct both pipe section and cover disc as well as hub and circular disc in one piece, so that only the pipe section and circular disc need to be joined together in the described manner.

The advantage of the described configuration is that critical stress areas, above all in the transition section between the circular disc and the pipe section, can be eliminated or at least mitigated to such an extent that the stress which does occur remains in an unobjectionable range and the risk of fracture as a result of crack formation is eliminated. A higher manufacturing accuracy, above all in the case of classifying wheels with outside diameters in excess of 250 mm, is achieved by designing the individual parts as simple ring elements that can be economically finished to size and balanced before assembly.

DETAILED DESCRIPTION OF THE INVENTION

Figure 1:
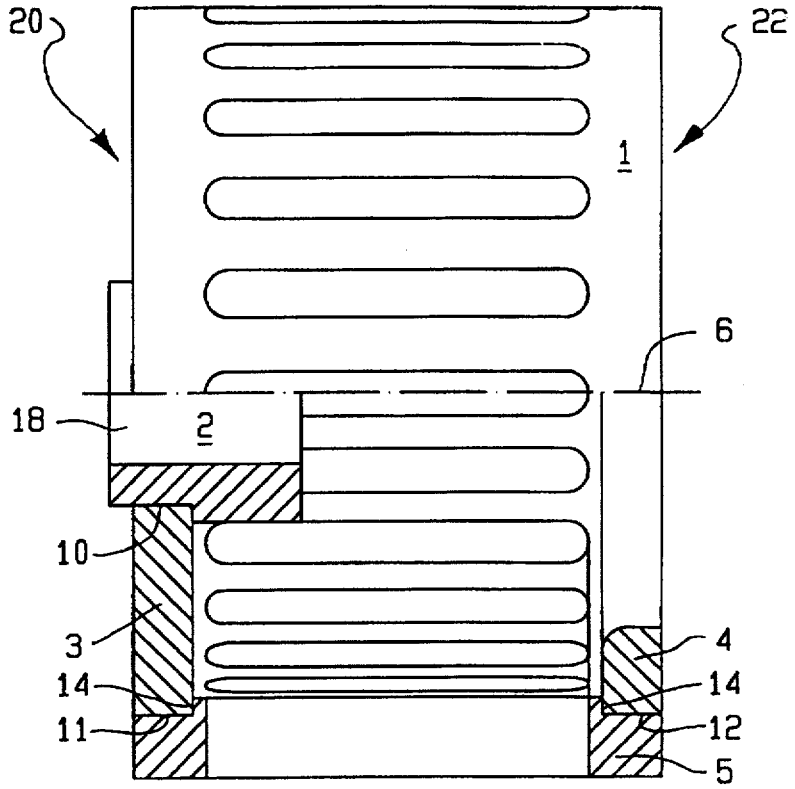
FIG. 1 is a side view of the classifying wheel, partly in cross-section.

The drawings show the classifying wheel of the present invention from two angles and in part in cross section. The classifying wheel 1 consists of a hub 2, circular disc 3, cover disc 4, and pipe section 5. All these parts are of one-piece construction and are manufactured of a sintered material each part is finished to size (preferably ground down) and balanced before assembly. Because the parts are simple ring elements, a high degree of manufacturing accuracy is achieved. As shown in FIG. 1, the classifying wheel 1 has a first axial end 20 and a second axial end 22. All references herein to first and/or second axial ends will follow this convention. The pipe section 5 has turned grooves, or stop faces 14 at either end that are concentric to the rotational axis 6 to accommodate and enable axial positioning of the circular disc 3 and the cover disc 4, and which are wide enough to accommodate the discs so that level, stepless front faces are formed for the classifying wheel on both sides, as shown in FIG. 1.

The hub 2, whose bore 18 has a semi-circular feather key groove (9), is fitted concentrically to the circular disc 3, whereby its axial position is dictated by its stepped circumference. A drive shaft (not shown) having a matching feather key may be inserted into the bore 18 to transmit torque to the classifying wheel 1. Employed to connect parts 2, 3, 4, and 5 is a self-setting filler. This filler may be an adhesive, such as a two-component adhesive, or a soldering material. The filler is introduced into gaps 10, 11, and 12 during assembly of the parts. Gaps 10, 11, and 12 are preferably 0.1 mm in width or smaller. In addition, gaps 10, 11, and 12, as shown in FIG. 1, are identified as lines because of their small size in relation to the size of the classifying wheel. It should be understood by a person skilled in the art that characters 10, 11 and 12 actually refer to gaps between the associated parts. Also, the shape of gaps 10, 11, and 12 may be conical such that the gaps taper axially.

Figure 2:
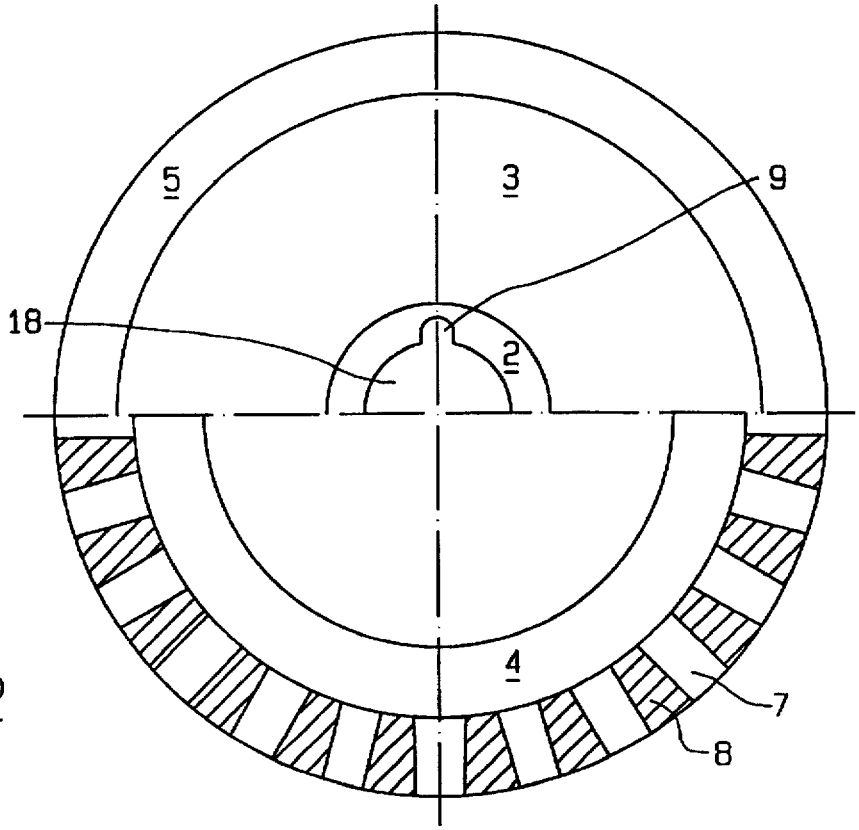
FIG. 2 is a composite top and bottom view of the classifying wheel, partly in cross-section.

Radially aligned flow channels 7, distributed uniformly around the periphery, are machined into the pipe section 5. These flow channels 7 are preferably in the shape of elongated holes. The channels' boundary walls run parallel to each other and in the direction of the rotational axis 6 and are joined at both ends by an arch section, so that classifying wheel vanes 8 with a cross-section that tapers radially to the inside are formed (FIG. 2). The arch sections are preferably at least as wide as the width of the circular disc 3 or cover disc 4. The vanes 8 are preferably evenly spaced around the circumference of pipe section 5.

I claim:

1. A classifying wheel of sintered material for an air classifier, through which the classifying air flows from outside to inside against the centrifugal action of the wheel (1), said wheel having a first (20) and second (22) axial end and defining a rotational axis (6), said classifying wheel comprising:

a cylindrical hub (2) having a bore (18) and a first (20) and a second (22) axial end extending along the rotational axis (6), said bore having a finished size enabling direct mounting of the classifying wheel onto a drive shaft;

a cylindrical pipe section (5) formed by a plurality of vanes (8) having first (20) and second (22) axial ends spaced circumferentially to define axially extending flow channels (7) therebetween formed by the surfaces of the vanes (8) which extend parallel to each other in the direction of the rotational axis (6), the axial ends (20, 22) of the flow channels (7) being connected to each other by arch-like surfaces in the areas adjacent the first and second axial ends;

a circular disc (3) carrying the hub (2) coaxially and arranged between the first axial end (20) of the hub (2) and the first axial end (20) of the pipe section (5); and an annular cover disc (4) arranged opposite the circular disk (3) adjacent the second axial end (22) of the pipe section (5), wherein said hub 2, circular disc 3, cover disk 4 and pipe section 5 are joined together by a self-setting filler introduced into a plurality of gaps (10, 11, 12) formed therebetween.

2. The classifying wheel according to claim 1, wherein the hub, pipe section, circular disc, and annular cover disc (2, 3, 4, and 5) are finished to size and balanced before assembly.

3. The classifying wheel according to claim 1, wherein the filler is an adhesive.

4. The classifying wheel according to claim 1, wherein the filler is a soldering metal.

5. The classifying wheel according to claim 1, wherein the width of the gaps (10, 11, and 12) between the hub (2), pipe section (5), circular disc (3), and annular cover disk (4) is a maximum of about 0.1 mm.

6. The classifying wheel according to claim 1, wherein the pipe section 5 defines at each axial end an annular stop face (14) to enable axial positioning of the circular disc (3) at the first axial end (20) of the pipe section (5) and the cover disc (4) at the second axial end (22) of the pipe section (5).

7. The classifying wheel according to claim 1, wherein the axial length of the arch section is at least as wide as the gauge of the circular disc (3) and cover disc (4).

8. The classifying wheel according to claim 1, wherein the hub (2) includes a groove (9) which extends axially for engagement with a complimentary shaped feather key in the drive shaft for transmission of torque, said groove (9) having a semi-circular cross-section.

9. The classifying wheel according to claim 2, wherein an outer facing surface of the circular disc (3) is planar and substantially aligns with the first axial end (20) of the pipe section (5).

10. The classifying wheel according to claim 2, wherein an outer facing surface of the annular cover disc (4) is planar and substantially aligns with the second axial end (22) of the pipe section (5).

11. The classifying wheel according to claim 1, wherein the vanes (8) are evenly circumferentially spaced.

12. The classifying wheel according to claim 1, wherein the vanes (8) have a substantially trapezoidal cross-section.

13. The classifying wheel according to claim 1, wherein the flow channels (7) are elongated holes for communication between the outer cylindrical surface of the classifying wheel and the inner cylindrical surface of the classifying wheel.

14. The classifying wheel according to claim 5, wherein at least one of the gaps (11) is defined coaxially to the rotational axis between the outer circumferential surface of the circular disc (3) and the inner circumferential surface of the pipe section (5) and the width of the gap (11) enlarges in the direction of the first axial end (20) of the pipe section (5).

15. The classifying wheel according to claim 5, wherein at least one of the gaps (12) is defined coaxially to the rotational axis between the outer circumferential surface of the cover disc (4) and the inner circumferential surface of the pipe section (5) and the width of the gap enlarges in the direction of the second axial end (22) of the pipe section (5).

16. A classifying wheel of sintered material for an air classifier equipped with a rotating classifying wheel through which classifying air flows from outside to inside against its centrifugal action, the wheel having vanes (8) which are arranged circumferentially and extend parallel to the axis of rotation (6) of the wheel, the vanes (8) being positioned between a circular disc (3) carrying the classifying wheel hub (2) and an annular cover disc (4), the classifying wheel comprising:

a wheel hub (2) having a central bore (18) for mating with a drive shaft of the classifying wheel and a semi-circular groove (9) extending axially along the inner surface of the bore for engagement with a matching feather key on the drive shaft for torque transmission;

said vanes (8) being bar-shaped with a substantially trapezoidal cross-section defining flow channels (7) having a cross-section in the form of an elongated hole providing open communication between the outer cylindrical surface of the classifying wheel and the inner cylindrical surface of the classifying wheel, said vanes (8) when combined forming a cylindrical pipe section having a first (20) and second (22) axial end;

a circular disc (3) carrying the wheel hub (2) coaxially and arranged adjacent the first axial end (20) of the pipe section (5); and an annular cover disc (4) arranged opposite the circular disc (3) adjacent to the second axial end (22) of the pipe section (5), wherein said wheel hub (2), circular disc (3), cover disc (4) and pipe section (5) are joined together by a self-setting filler to form the classifying wheel.

17. The classifying wheel according to claim 16, wherein an outer circumferential surface of the circular disc (3) and a mating inner circumferential surface of the pipe section (5) bound a circumferential gap (11) on the first axial end (20) of the pipe section (5) coaxially to the axis of rotation of the classifying wheel, the width of the gap being a maximum of about 0.1 mm.

18. The classifying wheel according to claim 16, wherein an outer circumferential surface of the cover disc (4) and a mating inner circumferential surface of the pipe section (5) bound a circumferential gap (12) on the second axial end (22) of the pipe section (5) coaxially to the axis of rotation of the classifying wheel, the width of the gap being a maximum of about 0.1 mm.

* * * * *

UNITED STATES PATENT AND TRADEMARK OFFICE
CERTIFICATE OF CORRECTION

PATENT NO. : 5,667,075

DATED : Sept. 16, 1997

INVENTOR(S) : Georg Konetzka

It is certified that errors appear in the above-identified patent and that said Letters Patent is hereby corrected as shown below:

Col. 1, line 46, change "background" to --Background--.

Col. 2, line 43, change "material" to --material.--

Col. 2, line 44, change "each part" to --Each part--.

Abstract

Line 15, change "self-sintering filler" to --self-setting filler--.

Signed and Sealed this

Twenty-fourth Day of February, 1998

*Attest:*

Bruce Lehman

BRUCE LEHMAN

*Attesting Officer*

*Commissioner of Patents and Trademarks*